US005687889A

United States Patent [19]

Liden

[11] Patent Number: 5,687,889

[45] Date of Patent: Nov. 18, 1997

[54] MULTI-PURPOSE REACHER AND DRESSING AID

[76] Inventor: Douglas T. Liden, 1350 California St. Apt. 306, San Francisco, Calif. 94109

[21] Appl. No.: 445,471

[22] Filed: May 18, 1995

[51] Int. Cl.[6] ..... A47G 23/80

[52] U.S. Cl. ..... 223/111; 223/113; 223/112; 223/116

[58] Field of Search ..... 223/111, 112, 223/113, 116, 118

[56] References Cited

U.S. PATENT DOCUMENTS

| | | | |
|---|---|---|---|
| 2,628,007 | 2/1953 | Meling | 223/111 |
| 3,149,384 | 9/1964 | Ryder | 24/68 |
| 3,401,856 | 9/1968 | Berlin | 223/111 |
| 3,604,604 | 9/1971 | Ahn | 223/111 |
| 3,860,156 | 1/1975 | Lawrence | 223/111 |
| 3,937,512 | 2/1976 | Baughman | 294/19 R |
| 4,328,605 | 5/1982 | Hutchison et al. | 24/115 G |
| 4,651,900 | 3/1987 | Banting | 223/111 |
| 4,966,316 | 10/1990 | George | 223/119 |
| 4,991,757 | 2/1991 | Deakyne | 223/112 |
| 5,315,741 | 5/1994 | Dubberke | 24/712.1 |

OTHER PUBLICATIONS

ADL, "Products for the Activities of Daily Living", (1995).

Smith & Nephew Rolyan, "1995 Activities of Daily Living Products", (1995).

North Coast Medical Consumer Products Division, After-Therapy™ Catalog. "Functional Solutions for Indpendent Living", (1994).

*Primary Examiner*—Bibhu Mohanty

[57] ABSTRACT

A manually operable combination device to help a user who cannot bend at the back, waist, or knees with applying socks, shoes, pants, tightening and loosening shoe laces, removing socks and picking things up off the ground. The device includes components to provide a reacher function with a pivoting closeable jaw operated by a trigger mechanism, a flexible or rigid plastic shovel, and a longitudinally sliding hook operated by a lever. The plastic shovel is used to apply socks and as a shoe horn. The reacher is used to apply shoes and remove socks and to pick articles up from floor. A sliding hook is used in conjunction with cord clamps on shoelaces to tighten laces. The hook is also used for application of pants.

17 Claims, 12 Drawing Sheets

MULTI-PURPOSE REACHER AND DRESSING AID

FIELD OF THE INVENTION

This invention relates to devices which are used to assist people who have difficulty in bending over (e.g. due back discomfort or dysfunction) to perform many daily activities such as putting on shoes, socks, and pants, tightening and loosening shoe laces, and picking things up off the floor.

BACKGROUND OF THE INVENTION

Many devices have been designed to assist people who cannot bend. Reachers 40 (FIG. 3) are devices which allow people to pick things up off the ground without bending over. Although there are various reacher designs, most consist of a rigid (usually aluminum) rod or channel with a pivoting jaw on one end and a pistol handle/trigger mechanism at the other. The pivoting trigger is attached via a string to the pivoting jaw. Pulling the trigger causes the jaw to close. A torsional spring in the pivoting attachment of jaw causes the jaw to reopen when the trigger is released.

This reacher is very important to people with limited bending ability because it provides simple accessibility to objects located on the ground. It may also be used for such activities as positioning shoes to step into and pulling off socks. Unfortunately, though, it cannot be used apply socks nor can it be used very practically for getting into shoes. Finally, it has no ability to tighten shoe-laces.

In order to put on socks, flexible or rigid plastic "sock aids" 42 are sold (FIG. 4). These devices 44 are typically shaped like a shovel and are attached to two flexible cords 46,48. The user slips the sock over the edge of the shovel, and while seated, steps into the semi-circular opening. By pulling up on the cords, the shovel is supposed to carry the sock over the foot and up the leg and then release the sock.

One of the inherent shortcomings of such devices is that the sock often slips off the shovel before it is completely over the foot. Certain technologies have been utilized in an attempt to prevent this. Some devices have fasteners which hook on the sock or stocking. Unfortunately, while these fasteners are certain to prevent the sock from slipping off the shovel too early, they must be manually released before the sock aid can be disengaged. Such an action requires the user to reach down below the knee. This is an obvious problem to many users. Other sock aids use a circular piece of foam on the back of the shovel to increase the friction between the shovel and the sock and thereby slow the rate at which the sock slides off the shovel. Still other sock aids are designed with notches cut out in the side of the shovel which also helps hold a sock on the device, by using the elastic of the sock which has contracted into the notch as the resistance to slipping off(e.g., U.S. Pat. No. 4,991,757 hereby incorporated herein by reference). However, while a certain design may work well with one type of sock, it will likely have problems with another type of sock (i.e. longer, more elastic, acrylic, etc.)

Another inherent problem with these sock aids is that they are virtually impossible to use while standing and are difficult to use with one hand since the cords must be pulled up simultaneously in a particular direction from behind the leg. This is often a problem for bad-back sufferers who have difficulty sitting and for people who have use of only one hand.

Devices have also been developed to help people put on shoes. Variations of a mechanical "shoe horn" are found in the prior art U.S. Pat. Nos. 2,628,007 to Meling, 4,966,316 to George et al., 3,604,604 to Ahn Classic style shoe horn in lengths up to 30" predominate the market. A shoe horn is vital for people who cannot use their hands to slip their shoes on. It is yet another tool that is required in the arsenal of dressing aids.

A variety of devices has also been introduced for the purpose of simplifying the actions required to fasten or tie shoe laces. These devices are important because, while laceless "slip-on" shoes are made for both men and women, many physical conditions such as herniated discs require shoes to be worn with the support and comfort of laces. Elastic laces provide the ability to slip into shoes without tying them. Unfortunately, they do not provide the support and stability that normal shoelaces provide when properly tied. Another device uses the lace holes in shoes to attach a Velcro fastener. Unfortunately, because they cover such a large portion of the shoe and are made in a limited number of colors, they often destroy the look of the shoe and draw unwanted attention to the user. Cord clamps 50 (U.S. Pat. No. 4,328,605) are now being used on shoe laces (FIG. 5). These spring-loaded devices (also referred to as "pinch fasteners") have a sleeve and plunger which are axially movable with respect to one another and are used to secure a drawstring in a fixed position. They have typically been employed in mountaineering equipment. Now, many people (including triathletes who wish to avoid the timely act of tying their shoes during transitions) use them on shoelaces. By tying the two ends of the lace together after being fed through the cord clamp, the laces form a loop. By pulling upward on this loop with one hand while pushing downward on the cord clamp with the other, the lace can be quickly tightened. To loosen the lace, the user simply pulls upward on the cord clamp.

None of these technologies, however, can be utilized without bending down to reach the shoe. Therefore, a person who cannot bend over to tie his/her shoes certainly could not bend over to tighten or loosen the cord clamps.

Finally, dressing sticks are sold to help with the application of pants. These devices are simply rigid rods with a fixed hook(s) at the end.

SUMMARY OF THE INVENTION

This invention can be used to do a multitude of activities without bending over an inch. It can be used to pick things up off the ground as the typical reacher does. It can also be used to easily apply socks either from a standing or sitting position. Unlike previous sock aids, socks do not slip off before they are over the foot. In addition, it can be used to put on shoes without the use of a separate shoe horn. By using it in conjunction with cord clamps on one's shoe laces, it can be used to tighten or loosen laces. It also can be used as a dressing stick or as an undressing stick (to remove socks). This one device accomplishes more effectively what currently takes four devices to do (long shoe horn, standard reacher, dressing stick, and sock aid). Currently, these four devices are sold together on the market as a "hip-kit".

Not only does this device alleviate the need to carry around four different devices, it also tightens shoe laces from a standing or sitting position. This is something no previous device was able to do.

DETAILED DESCRIPTION

Figure 1:
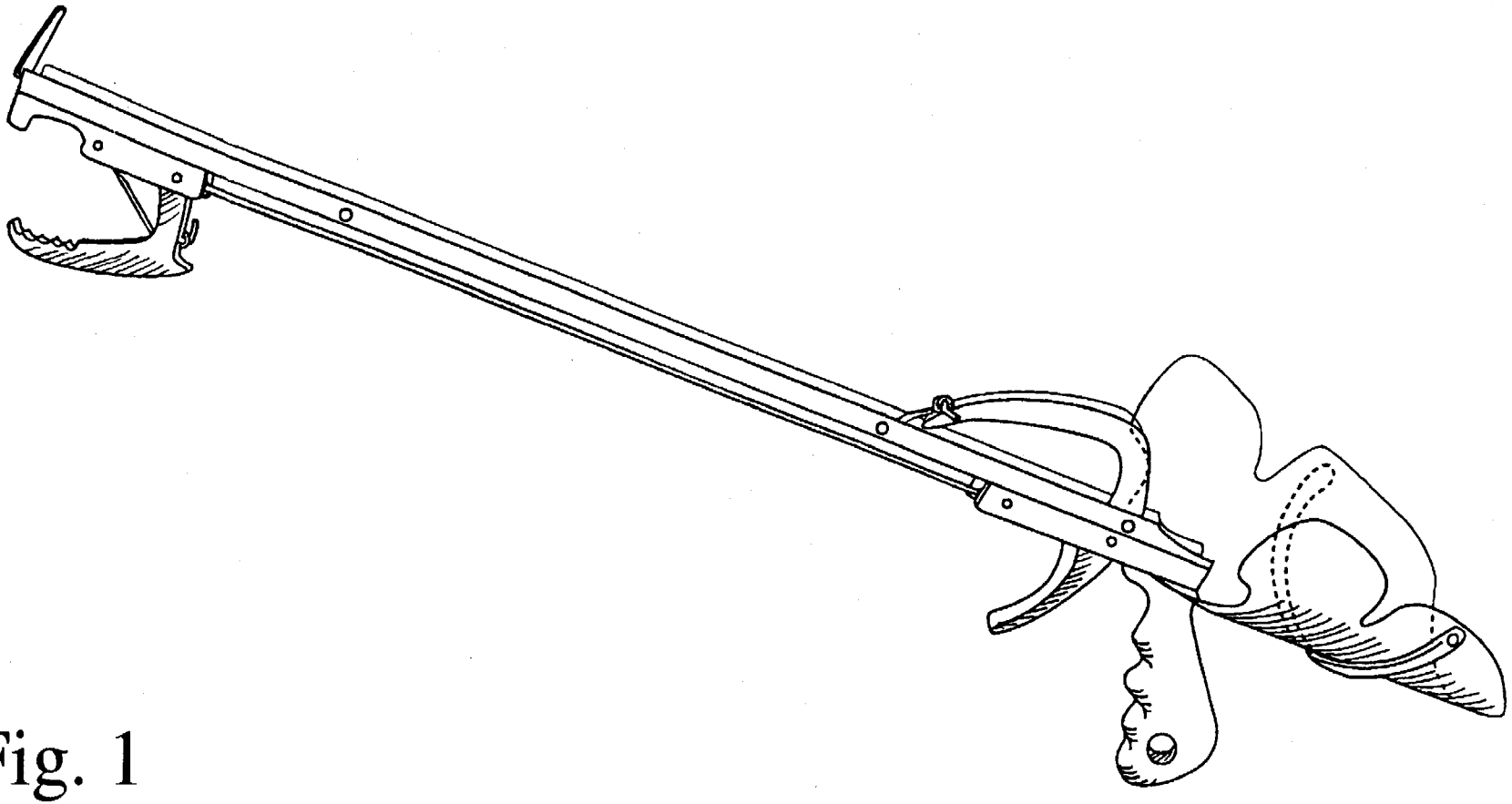
FIG. 1 is a perspective view of an embodiment according the invention.
Figure 2:
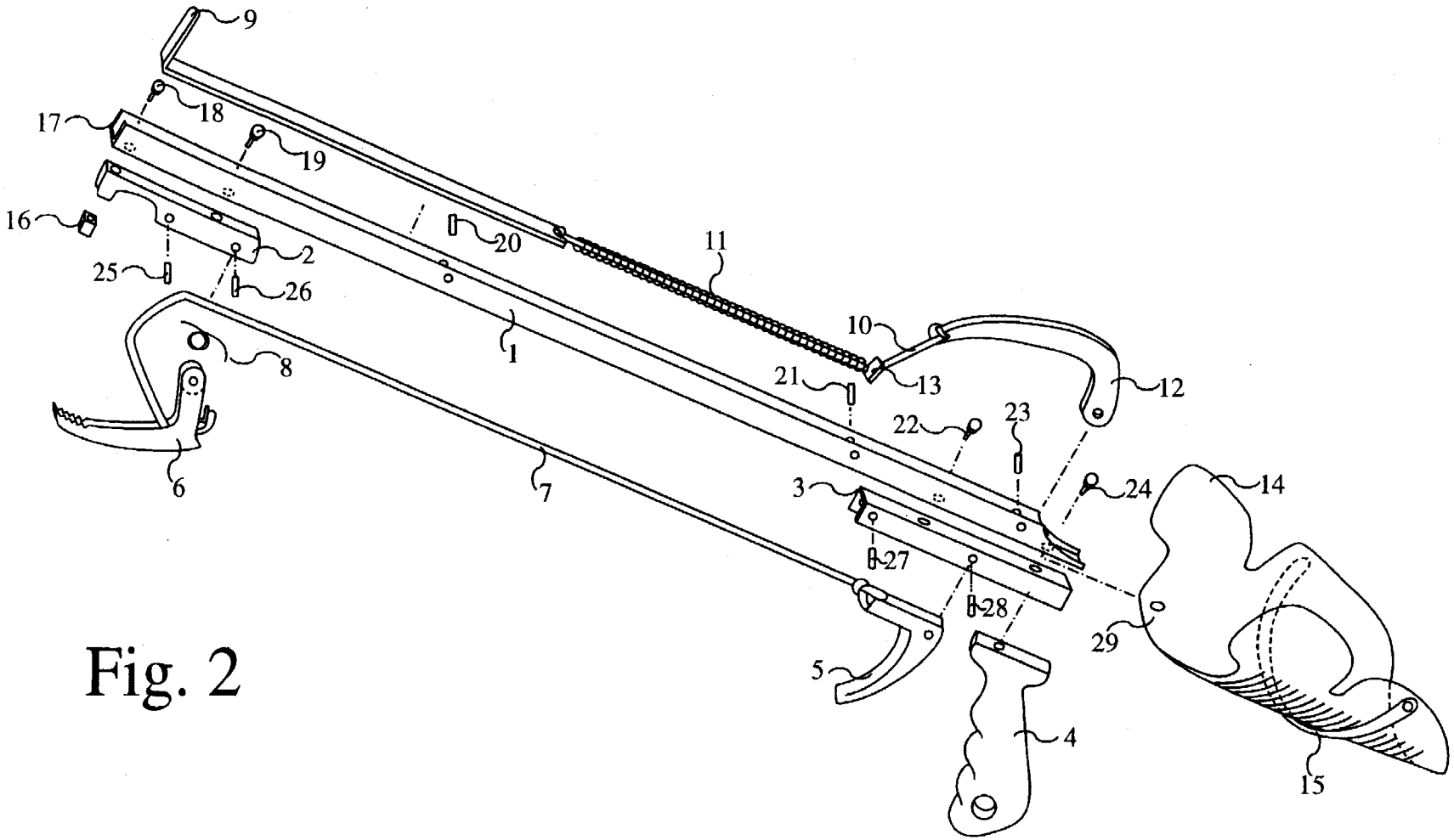
FIG. 2 is an exploded view of the embodiment of FIG. 1.
Figure 3:
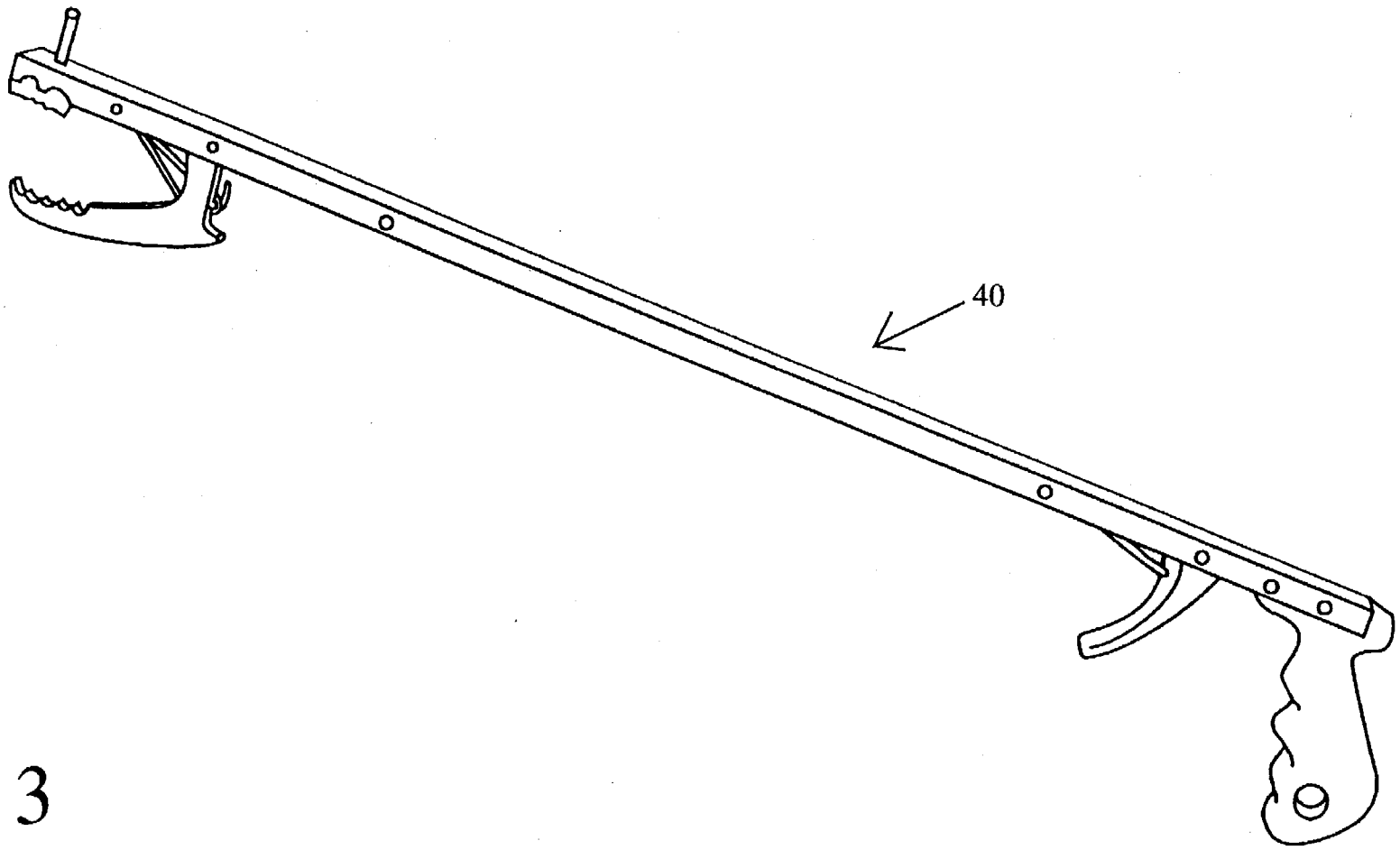
Fig. 3 (PRIOR ART)
FIGS. 3, 4, and 5 are perspective drawings of prior art reacher, sock aid, and lace clamping devices.
Figure 4:
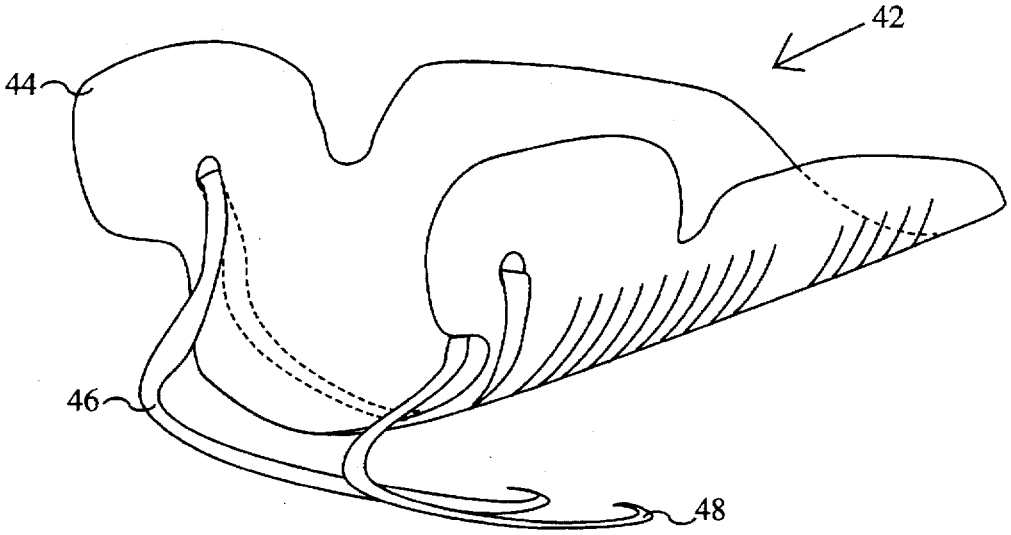
Fig. 4 (PRIOR ART)

FIG. 2 shows an exploded diagram of an embodiment according to the invention. The main body is a main channel 1 comprised of a rigid, lightweight material such as aluminum, plastic or carbon fiber. A rigid hook 9 (flat bar with a 90 degree bend) at one end sits within a first end of the channel. A pin 20 is mounted across main channel 1 but above the hook allowing the hook to slide within main channel 1 and preventing the hook 9 from falling out of main channel 1.

At the distally opposite (second) end of main channel 1, a lever 12 is mounted. Lever 12 pivots about a pin 23. The end of lever 12 is attached to a string 10 or other flexible material (such as a cable). The string 10 travels under a pin 21, through a washer 13, and a compression spring 11, within main channel 1, and is attached at the other end to hook 9. Washer 13 is sized so that it cannot fit under pin 21 and thereby prevents spring 11 from leaving the channel. The hook has a longitudinal leg extending along and generally parallel to a longitudinal axis of the channel and a lateral leg extending laterally from the channel. The hook and the channel at a jaw end of the channel are slidably engaged to maintain the longitudinal leg and the channel generally parallel to one another as the hook moves along the longitudinal axis of the channel. The longitudinal leg is manipulated to move toward and away from a handle end of the channel by operation of the lever 12 attached to the channel. The channel at the jaw end includes a slotted opening having an edge configured to receive and surround the path of a loop of laces as the loop is pulled toward the handle end of the rod by the hook moving in that direction. The slotted opening (washer 13) is sized to allow passage of the laces and not allow passage of a clamping device which urges the two sides of a loop of shoe laces together to hold them during use. The loop of the laces can be pulled through the clamping device by positioning the clamping device against the slotted opening and looping the loop of laces over the lateral leg and moving the hook toward the handle end of the channel. The washer 13 and the pin 21 also cause the spring 11 to compress when the lever 12 is activated. When the lever 12 is lifted, the hook 9 slides up the main channel 1. When the lever 12 is released, gravity and the compression spring 11 cause the hook 9 to travel back down main channel 1 to the end of the main channel 1.

At the base (back) of the main channel 1 components of a standard reacher unit are attached without the normal cable enclosing midsection of the reacher. The reacher consists of a jaw channel 2 and a handle channel 3 made of similar material as main channel 1. The jaw channel 2 is attached to main channel 1 with a pin 18 and a pin 19. Handle channel 3 is attached to the other end of main channel 1 with a pin 22 and a pin 24. A pistol-type handle 4 is mounted with handle channel 3. A pivoting trigger (handle) 5 is mounted immediately in front of handle 4 with pin 28. At the jaw end of the device, a pivoting arm (or jaw) 6 is mounted in jaw channel 2 with a pin 26. A torsional spring 8 surrounds pin 26. A string 7 or other flexible material is attached to the arm 6. The string 7 travels around a pin 25, over pins 26 and 27, and attaches to trigger 5. A rubber piece 16 may be mounted in jaw channel 2 to provide a better gripping surface. When the trigger 5 is pulled so that the trigger pivots on pin 28, the string 7 is tensioned causing the arm 6 to close to the rubber piece 16.

Mounted between main channel 1 and handle channel 3 is a flexible or rigid shovel 14 (sock aid), preferably made of plastic. The flexible sheet material having: a toe portion at one end thereof with two opposite diverging edge formations adapted to flex towards each other upon application of a sock distended thereon, so as to present a cavity between the toe portion and sock for insertion of a foot. The toe edge formations terminating at opposite lateral engaging projections adapted to releasably frictionally engage the sock. A heel portion at the other end of such sheet material is integrally connected to the toe portion in the region adjacent the engaging projections. The heel portion includes two opposite edge formations diverging from the engaging projections to the other end, so as to present a flexible connecting portion between the toe and heel portions to permit hinged flexure of the heel portion relative the toe portion. An outside of the flexible sheet material when the cavity is presented includes a rubber strip mounted to and across the back of the flexible piece of plastic at a location generally adjacent to the lateral engaging projections. A puller (e.g. a bar) connected to the heel portion is adapted to be pulled so as to draw the toe portion with the sock over the foot thereby unraveling the sock from the engaging projections and permitting the heel portion to flex over the heel of the user for drawing the sock over the leg. The thin rubber strip 15 is riveted or otherwise attached approximately midway transversely across the back of shovel 14. This spreads the holding force across the nearly the full width of the shovel which thereby prevent the sock from bunching up or otherwise distorting, so that a fully inserted taut fit is achieved over the foot while the sock extends over the full width of the rubber strip 15 during the insertion process. When the sock slips off the rubber strip, bunching and distortion can occur. The shovel 14 is mounted through a hole 29 in shovel 14 by the pin 24.

Operation (FIGS. 2, 5–13)

Figure 6:
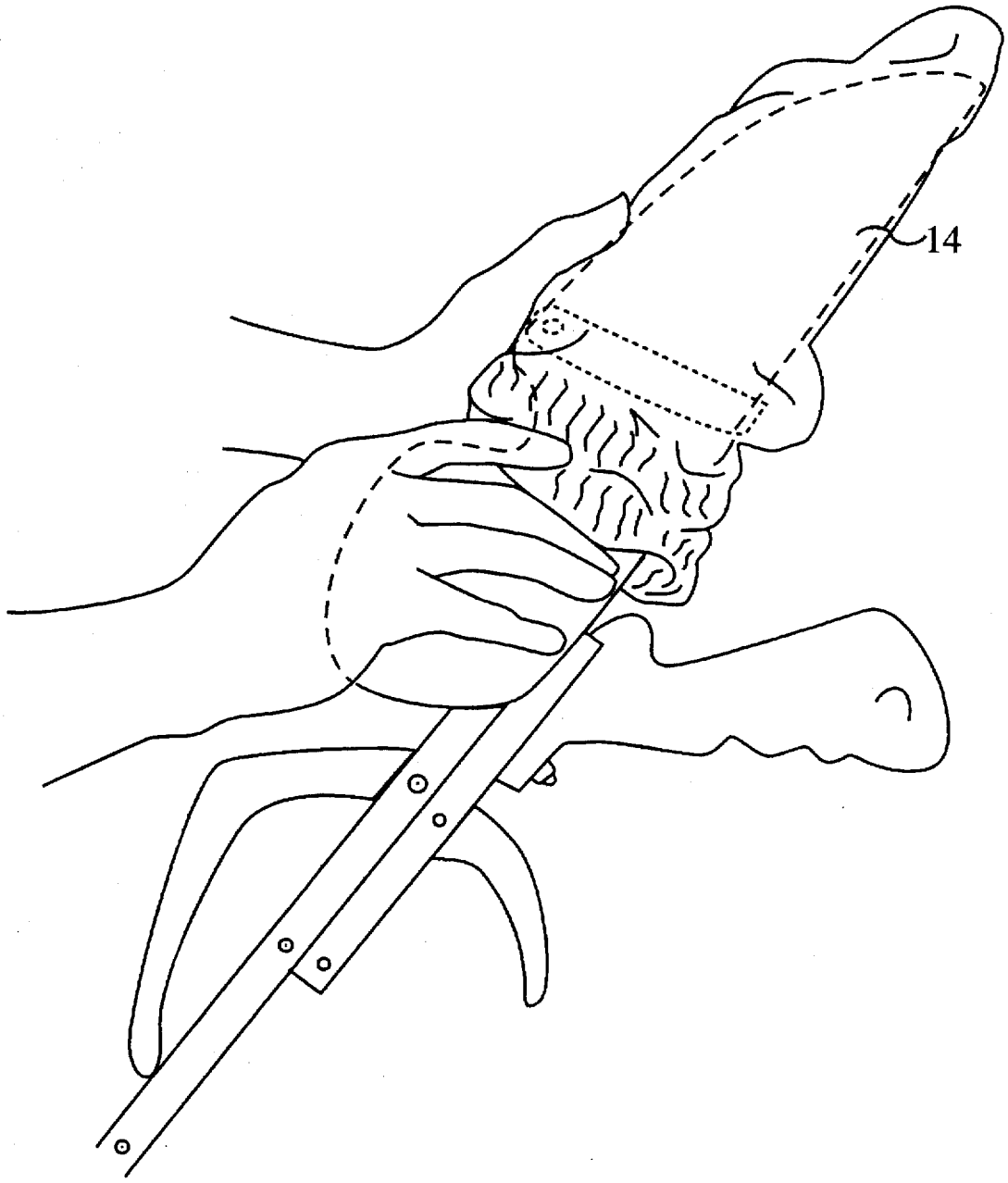
FIGS. 6, 7 and 8 show progressive steps of how to use the device of FIG. 1 to apply socks.
Figure 7:
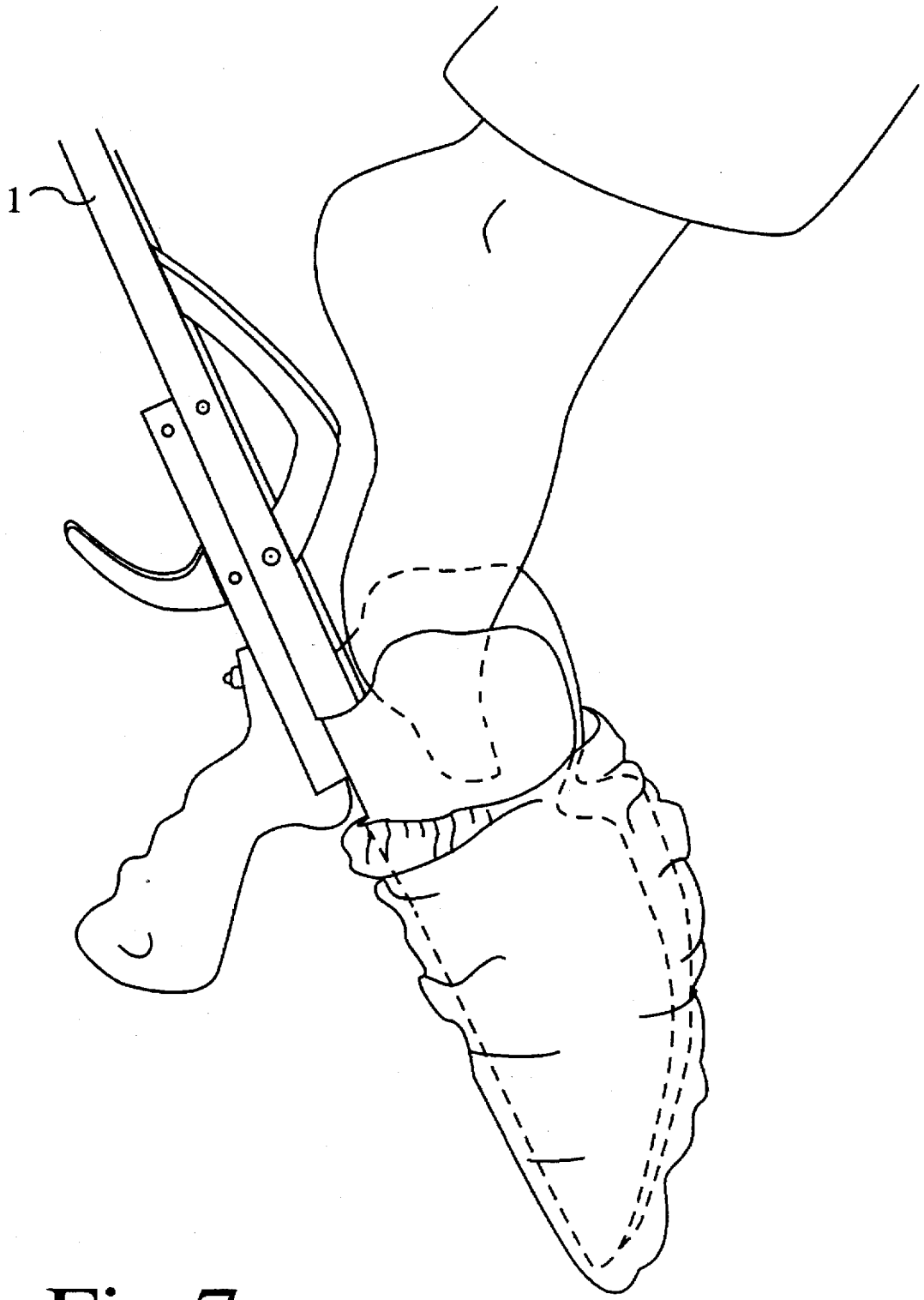
Figure 8:
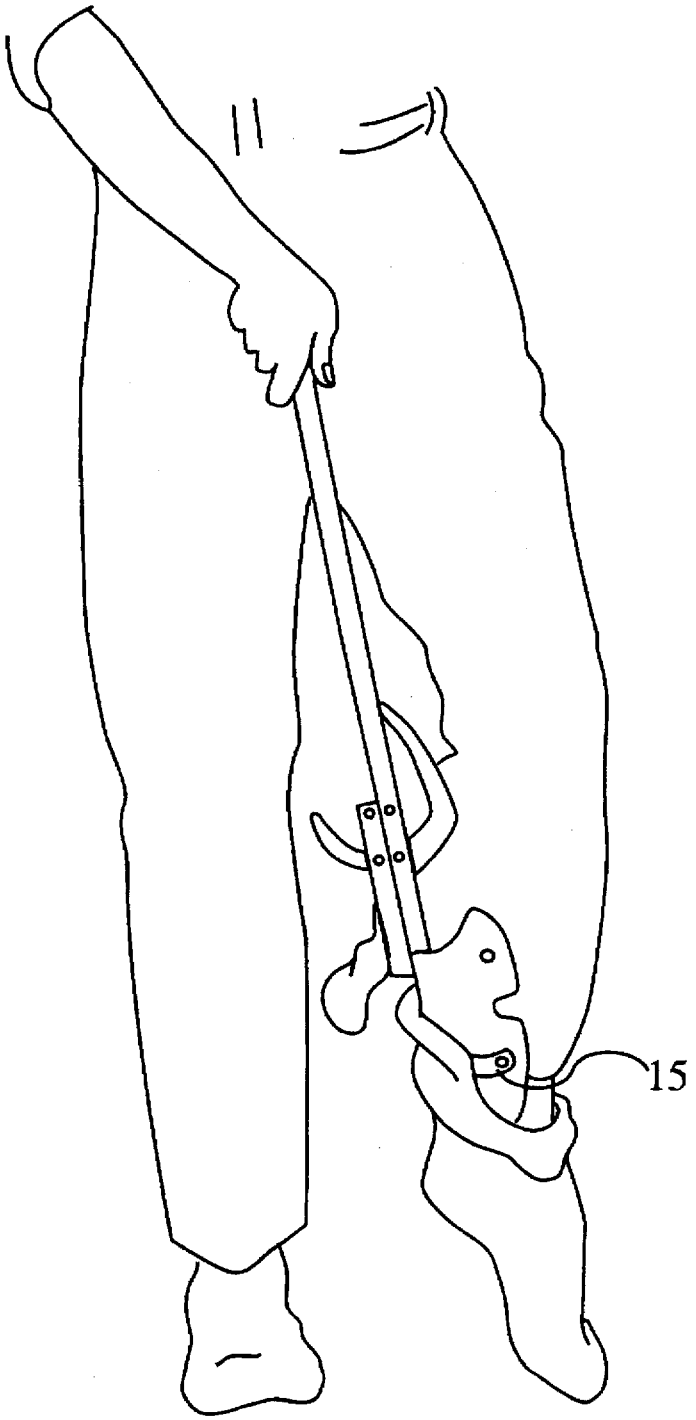

To apply a sock, one simply slips the entire sock over the lip of shovel 14. (FIG. 6). If the shovel is made of a flexible material, as it is in the preferred embodiment, the sock will cause the sides of the shovel to bend inward towards the centerline making it more cylindrical in appearance. The user then holds channel near jaw end of the device, while sitting or standing, he/she steps into sock opening (FIG. 7). The user then pulls the sock over the foot by pulling upward on main channel 1. When the sock is at its most outstretched position, it will release from lip 15 and sock is applied (FIG. 8).

During the course of application, the sides of the shovel may flex to provide room for the foot. The rubber strip 15 across the shovel stretches as the sides of the shovel are bent inward towards the centerline by the elasticity of the sock. Therefore, the rubber strip is beneficial in preventing the foot opening from becoming too small. The rubber strip is also helpful in returning the shovel to its natural position. Most importantly, the rubber strip is vital because it holds the sock on the shovel, by acting as a larger cross-section which resists the sock being pulled across it. The surface tackiness (friction) of the rubber strip 15 also increases the effective drag on a sock as it slips over the rubber strip to help resist the sock from being pulled off while it is being pulled over the foot until the foot meets the end of the sock at which point the force pulling the sock off the shovel exceeds the resisting force and the shovel can be removed.

While the embodiment described above details a rigid attachment of the shovel to the end of the channel, the shovel could also be allowed swivel about pin 24. This could make it easier for people to use while sitting.

To remove socks, simply insert the reacher arm 6 between sock and leg, pull the trigger 5 to grab sock, and pull sock off of the foot.

Figure 9:
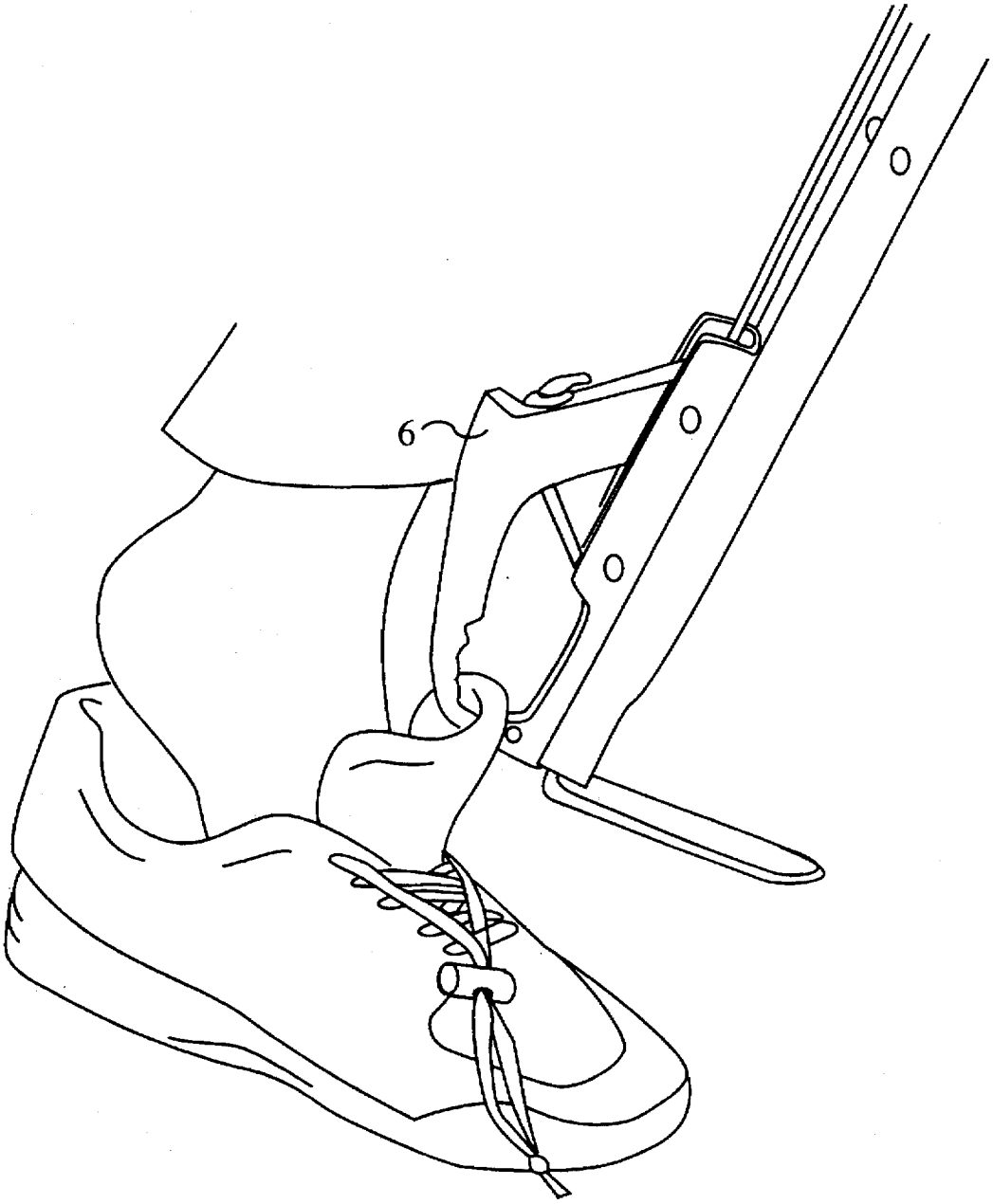
FIGS. 9 and 10 show progressive steps of how to use the device of FIG. 1 to assist in putting on a shoe.
Figure 10:
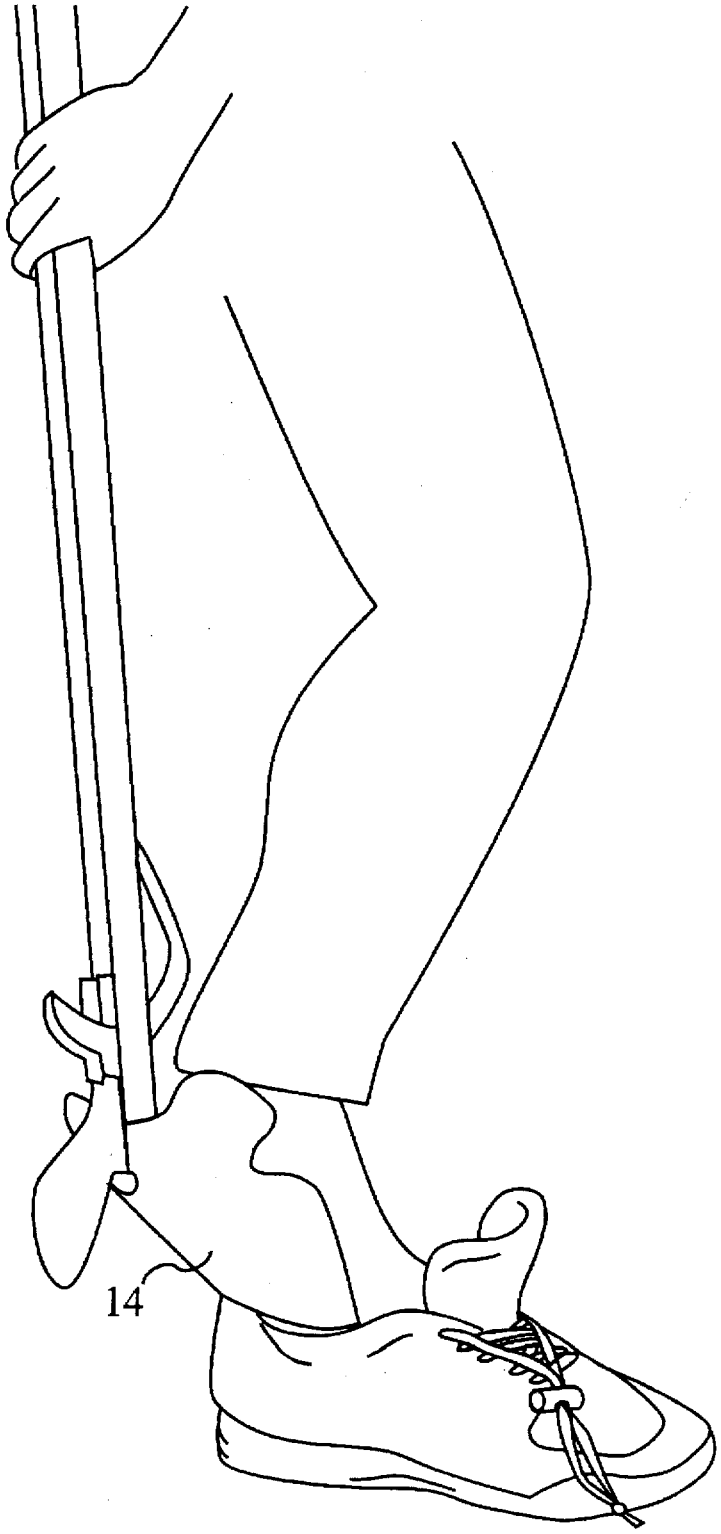

To apply shoes, the user grabs the tongue of shoe with reacher arm 6 and by pulling trigger 5. He/she then places the toe end of the foot into the shoe (FIG.9). The user then flips the device around in its opposite direction and uses the inside of the shovel 14 as a shoe horn (FIG. 10).

Figure 5:
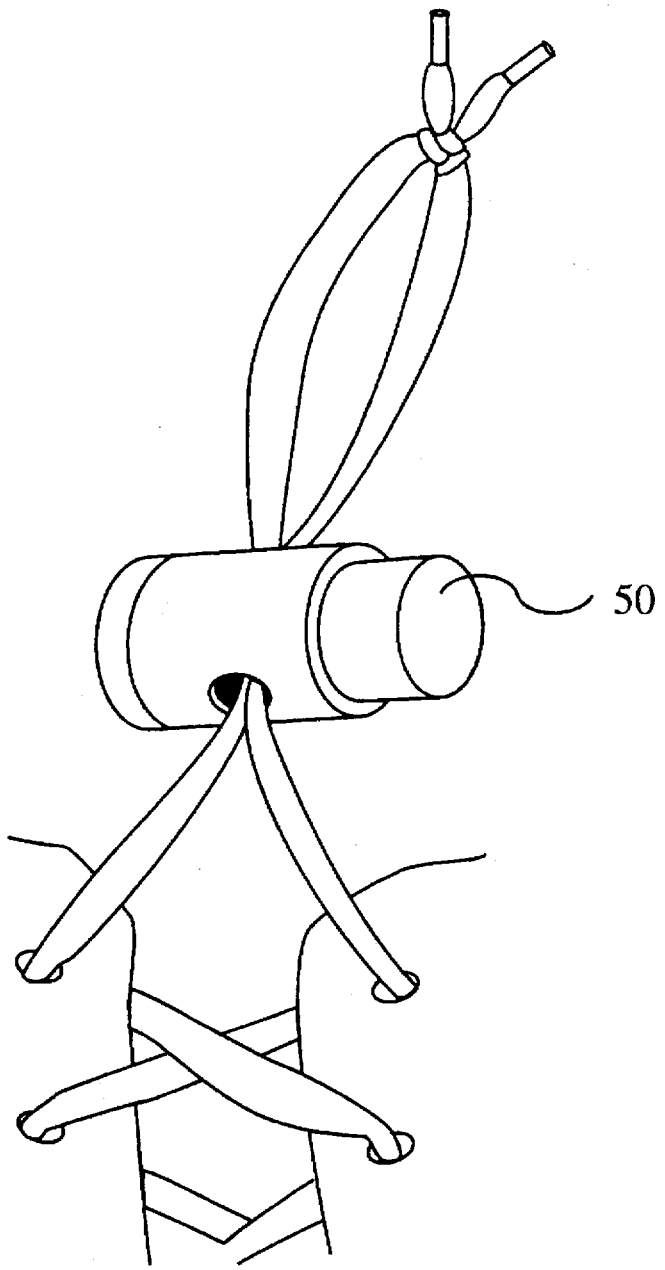
Fig. 5 (PRIOR ART)
Figure 11:
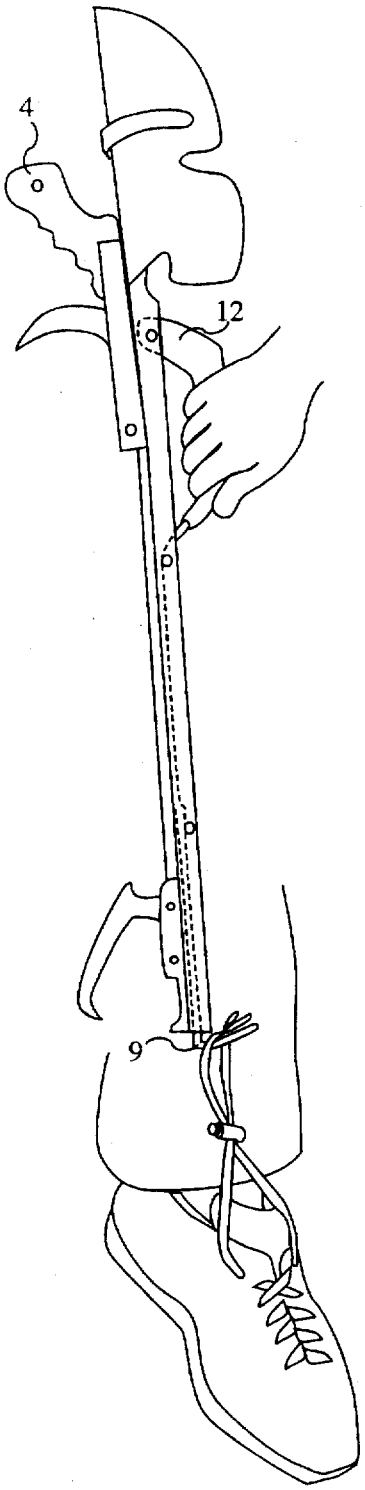
FIGS. 11, 12, and 13 show progressive steps of how to use the device of FIG. 1 to tighten shoe laces.
Figure 12:
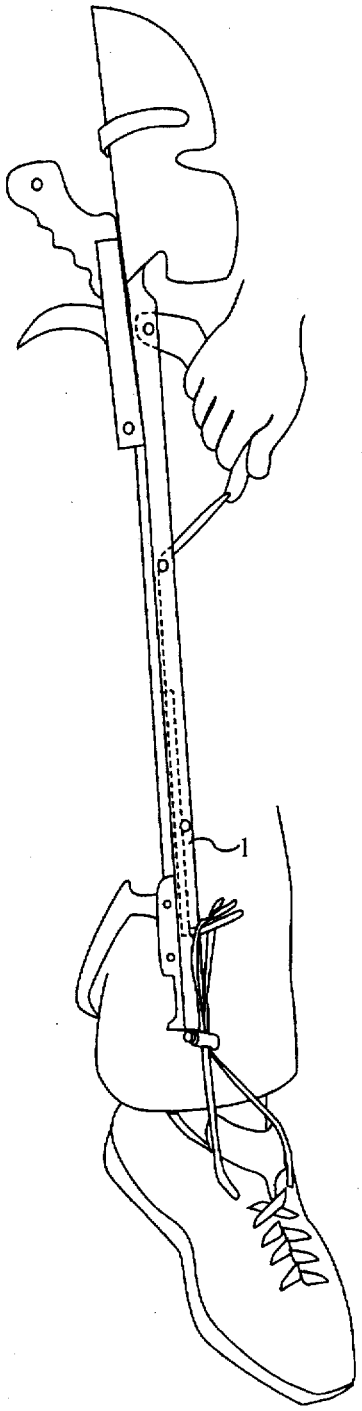
Figure 13:
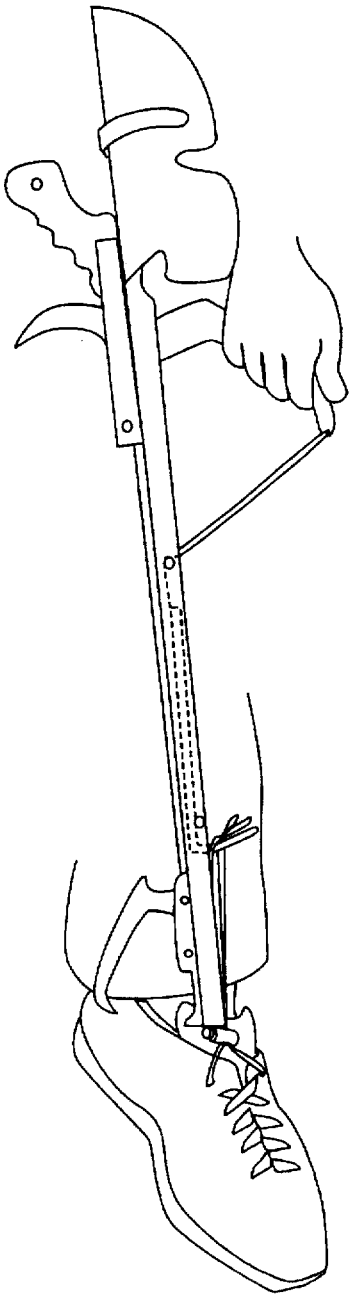

To tighten laces, the user first must have applied cord clamps to his/her laces. This is a simple one-time operation. The user simply feeds the two lace ends through the cord clamp and then ties the two ends of the lace together. This action creates a loop (FIG. 5). (The laces may be need to be shortened to prevent this loop from reaching the ground). Once the user has cord clamps on his/her shoes, he/she simply holds the device by lever arm 12. He/she then grabs the loop with hook 9 (FIG. 11). Then, by pulling up on the lever arm, the hook and the lace loop slides up main channel 1 (FIG. 12). Because the cord clamp is too large to fit into main channel 1, the jaw end of the channel (at 17—FIG. 2) pushes the cord clamp downward and thereby tightens the laces. The upward pull on the lever thereby has a resultant force downward on main channel 1. When the lever is released, gravity and the compression spring 11 will return lever and the sliding hook to their normal position. (Without the spring, the lever would fall open when device is turned upside down for the application of socks and would interfere with foot entry into the sock.)

While this device as described above can be used with one hand, users with less arm strength can place one hand on pistol handle 4 and the other on lever 12. Using both hands requires considerably less strength.

Figure 14:
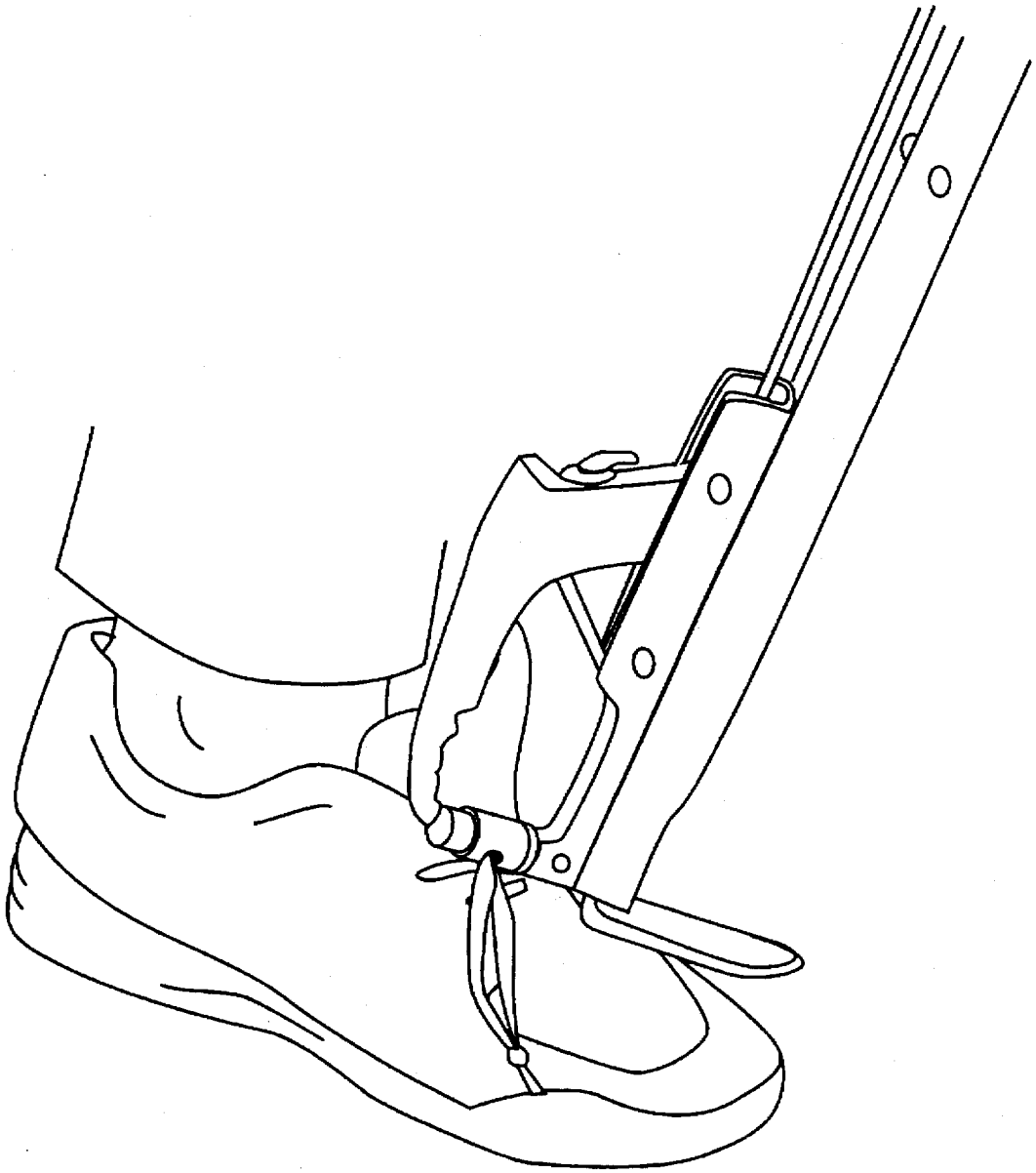
FIG. 14 demonstrates how to use the device of FIG. 1 to loosen laces.

To loosen the laces, one uses the reacher portion of the invention to grab the cord clamp and pulls upward (FIG. 14).

To utilize this device as a dressing stick, one simply uses hook 9 at the end to pull on pants, etc.

Summary

This device replaces the need for four other devices. But not only does the device alleviate the need to carry four separate devices, it works far more effectively and does more than those four devices can do. For example, because the sock aid is now attached to a rigid structure as opposed to nylon cords, it can now be used while standing and with only one hand. It can also be used as a shoe horn. Furthermore, because the sock shovel and the sliding hook are now attached to a reacher, the reacher's utility has broadened. The reacher, which was once used simply to pick things up off the ground, can now be used to apply shoes and loosen laces. Finally, this device applies an entirely unique technology to tighten laces. There is no other device known to the applicant that can be used for tightening laces from a standing or sitting position without bending.

Although the description above contains many specifications described for a particular device according the invention, these should not be construed as limiting the scope of the invention but as merely providing illustrations of some of the presently preferred embodiments of this invention. For example, the channel could be cylindrical in shape. The main body of the invention may be formed from one piece or it may be divided in the middle to allow the device to collapse and be more portable. The lever, reacher arm, hook, trigger, handle and shovel may be of different shapes, materials, etc. Those skilled in the art will recognize that changes can be made in form and detail without departing from the spirit and scope of the invention.

What is claimed:

1. A device to assist a user in dressing, comprising in combination:

a reacher including a movable jaw for clamping an item to be held between the jaw and a jaw mating portion at a jaw end of a generally rigid rod, said jaw of said reacher being manipulated toward and away from said jaw mating portion by operation of a trigger generally disposed at a handle end of said rod; and an exposed sock aid also disposed at said handle end of said rod, said sock aid including a flexible sheet material having:

(i) a toe portion at one end thereof with two opposite edge formations adapted to flex towards each other upon application of a sock distended thereon, so as to present a cavity between the toe portion and sock for insertion of a foot, and flex away from each other to allow insertion of a foot in said cavity; and (ii) a heel portion at the other end of such sheet material integrally connected to said toe portion, said heel portion being generally fixedly connected to said handle end of said reacher and adapted to be pulled by said rod so as to draw said toe portion with said sock over the foot thereby unraveling said sock from said flexible sheet.

2. The device to assist a user in dressing as in claim 1, further comprising in the combination:

a hook having a longitudinal leg extending along and generally parallel to a longitudinal axis of said rod and a lateral leg extending laterally to the longitudinal axis of said rod, wherein said hook and said rod at said jaw end of said reacher are slidably engaged to maintain the longitudinal leg and said rod generally parallel to one another as the hook moves along said longitudinal axis of said rod, wherein said longitudinal leg is manipulated to move toward and away from said handle end of said rod by operation of a lever attached to said rod, wherein said rod at said jaw end includes a opening having an edge configured to receive and surround the path of a loop of laces as the loop is pulled toward the handle end of the rod by the hook moving in that direction, wherein the opening is sized to allow passage of the laces and not allow passage of a clamping device which urges the two sides of said loop of laces together to hold them for later use, wherein said loop of said laces can be pulled through said clamping device by positioning the clamping device against said opening and looping said loop of laces over said lateral leg and moving said hook toward said handle end of said rod.

3. The device to assist a user in dressing as in claim 1, wherein the flexible sheet further includes:

toe edge formations terminating at opposite lateral engaging projections adapted to releasably frictionally engage said sock, wherein an outside of said flexible sheet material when said cavity is presented includes an elastomeric strip mounted to and across the back of the flexible piece of plastic at a location generally adjacent to the lateral engaging projections.

4. The device to assist a user in dressing as in claim 2, wherein the flexible sheet further includes:

toe edge formations terminating at opposite lateral engaging projections adapted to releasably frictionally engage said sock, wherein an outside of said flexible sheet material when said cavity is presented includes an elastomeric strip mounted to said and across the back of the flexible piece of plastic at a location generally adjacent to the lateral engaging projections.

5. The device to assist a user in dressing as in claim 1, wherein said rod is a channel.

6. The device to assist a user in dressing as in claim 2, wherein said rod is a channel and wherein said opening is formed by said end opening of said channel.

7. The device to assist a user in dressing as in claim 2, wherein said slidable engagement of said hook to said jaw end of said reacher is supplemented by an elastic member which urges the hook toward the jaw end of said rod.

8. The device to assist a user in dressing as in claim 6, wherein said slidable engagement of said hook to said jaw end of said reacher is supplemented by an elastic member which urges the hook toward the jaw end of said rod.

9. The device as in claim 1, wherein a width of said sheet material is such that the cavity created for insertion of the foot is large enough to freely receive a substantial portion of the toes of such a foot before further stretching of the sock occurs as the foot is inserted further.

10. A device to assist a user in dressing, comprising in combination: a reacher including a movable jaw for clamping an item to be held between the jaw and a jaw mating portion of a jaw end of a generally rigid rod, said jaw of said reacher being manipulated toward and away from said jaw mating portion by operation of a trigger generally disposed at a handle end of said rod; and a hook having a longitudinal leg extending along and generally parallel to a longitudinal axis of said rod and a lateral leg extending laterally to the longitudinal axis of said rod, wherein said hook and said rod at said jaw end of said reacher are slidably engaged to maintain the longitudinal leg and said rod generally parallel to one another as the hook moves along said longitudinal axis of said rod, wherein said longitudinal leg is manipulated to move toward and away from said handle end of said rod by operation of a lever attached to said rod, wherein said rod at said jaw end includes a opening having an edge configured to receive and surround the path of a loop of laces as the loop is pulled toward the handle end of the rod by the hook moving in that direction, wherein the opening is sized to allow passage of the laces and not allow passage of a clamping device which urges the two sides of said loop of laces together to hold them for later use, wherein said loop of said laces can be pulled through said clamping device by positioning the clamping device against said opening and looping said loop of laces over said lateral leg and moving said hook toward said handle end of said rod.

11. The device to assist a user in dressing as in claim 10, wherein said rod is a channel.

12. The device to assist a user in dressing as in claim 11, wherein said rod is a channel and wherein said opening is formed by said end opening of said channel.

13. The device to assist a user in dressing as in claim 11, wherein said slidable engagement of said hook to said jaw end of said reacher is supplemented by an elastic member which urges the hook toward the jaw end of said rod.

14. The device to assist a user in dressing as in claim 12, wherein said slidable engagement of said hook to said jaw end of said reacher is supplemented by an elastic member which urges the hook toward the jaw end of said rod.

15. A device to assist a user in dressing, comprising in combination:

a rod having a handle end and a jaw end;

a sock aid including flexible sheet material having:

(i) a toe portion at one end thereof with two opposite edge formations adapted to flex towards each other upon application of a sock distended thereon, so as to present a cavity between the toe portion and sock for insertion of a foot; and (ii) a heel portion at the other end of such sheet material integrally connected to said toe portion, said heel portion being generally fixedly connected to said handle end of said rod and adapted to be pulled by said rod so as to draw said toe portion with said sock over the foot thereby unraveling said sock from said flexible sheet and permitting said heel portion to flex over the heel of the user for drawing said sock over the leg; and a hook having a longitudinal leg extending along and generally parallel to a longitudinal axis of said rod and a lateral leg extending laterally to the longitudinal axis of said rod, wherein said hook and said rod at said jaw end of said rod are slidably engaged to maintain the longitudinal leg and said rod generally parallel to one another as the hook moves along said longitudinal axis of said rod, wherein said longitudinal leg is manipulated to move toward and away from said handle end of said rod by operation of a lever attached to said rod, wherein said rod at said jaw end forms a channel having an edge configured to receive and surround the path of a loop of laces as the loop is pulled toward the handle end of the rod by the hook moving in that direction, wherein the opening of said channel within said rod is sized to allow passage of the laces and not allow passage of a clamping device which urges the two sides of said loop of laces together to hold them for later use, wherein said loop of said laces can be pulled through said clamping device by positioning the clamping device against said opening and looping said loop of laces over said lateral leg and moving said hook toward said handle end of said rod.

16. The device to assist a user in dressing as in claim 2, wherein the flexible sheet further includes:

toe edge formations terminating at opposite lateral engaging projections adapted to releasably frictionally engage said sock, wherein an outside of said flexible sheet material when said cavity is presented includes an elastomeric strip mounted to said and across the back of the flexible piece of plastic at a location generally adjacent to the lateral engaging projections.

17. A device to assist a user in dressing, comprising in combination:

a rod having a handle end and a jaw end;

a hook having a longitudinal leg extending along and generally parallel to a longitudinal axis of said rod and a lateral leg extending laterally to the longitudinal axis of said rod, wherein said hook and said rod at said jaw end of said rod are slidably engaged to maintain the longitudinal leg and said rod generally parallel to one another as the hook moves along said longitudinal axis of said rod, wherein said longitudinal leg is manipulated to move toward and away from said handle end of said rod by operation of a lever attached to said rod, wherein said rod at said jaw end forms a channel having an edge configured to receive and surround the path of a loop of laces as the loop is pulled toward the handle end of the rod by the hook moving in that direction, wherein the opening of said channel within said rod is sized to allow passage of the laces and not allow passage of a clamping device which urges the two sides of said loop of laces together to hold them for later use, wherein said loop of said laces can be pulled through said clamping device by positioning the clamping device against said opening and looping said loop of laces over said lateral leg and moving said hook toward said handle end of said rod.

* * * * *